United States Patent [19]

Edison

[11] 4,227,540

[45] Oct. 14, 1980

[54] MENTHOL FILTER FOR CIGARETTES

[76] Inventor: Robert G. Edison, 3032 University Ave., Highland Park, Ill. 60035

[21] Appl. No.: 918,365

[22] Filed: Jun. 23, 1978

[51] Int. Cl.[3] ..... A24F 13/02

[52] U.S. Cl. ..... 131/187; 131/225; 131/261 A

[58] Field of Search ..... 131/187, 10.1, 144, 131/261A

[56] References Cited

U.S. PATENT DOCUMENTS

| | | | |
|---|---|---|---|
| 2,117,492 | 5/1938 | Meyer | 131/187 |
| 3,339,557 | 9/1967 | Karalus | 131/10.1 X |

FOREIGN PATENT DOCUMENTS

| | | | |
|---|---|---|---|
| 1075987 | 10/1954 | France | 131/187 |

*Primary Examiner*—Stephen C. Pellegrino
*Attorney, Agent, or Firm*—Gerald S. Geren

[57] ABSTRACT

A cylindrically-shaped menthol cartridge is adapted to be placed within the hollow body portion of an elongated, two-piece cigarette holder. The holder includes a flattened member adapted for reception in the mouth of a user, and a generally cylindrical member adapted to receive a cigarette, cigar or other smokable, tobacco-filled cylinder. The cylindrically-shaped cartridge is packed with menthol crystals and includes vented end walls through which smoke from the burning tobacco may pass before flowing to the smoker. Inhalation of the menthol fumes mitigates the toxicity of the tars and nicotine from the burning tobacco and soothes the mucous membranes in the nose and mouth.

1 Claim, 9 Drawing Figures

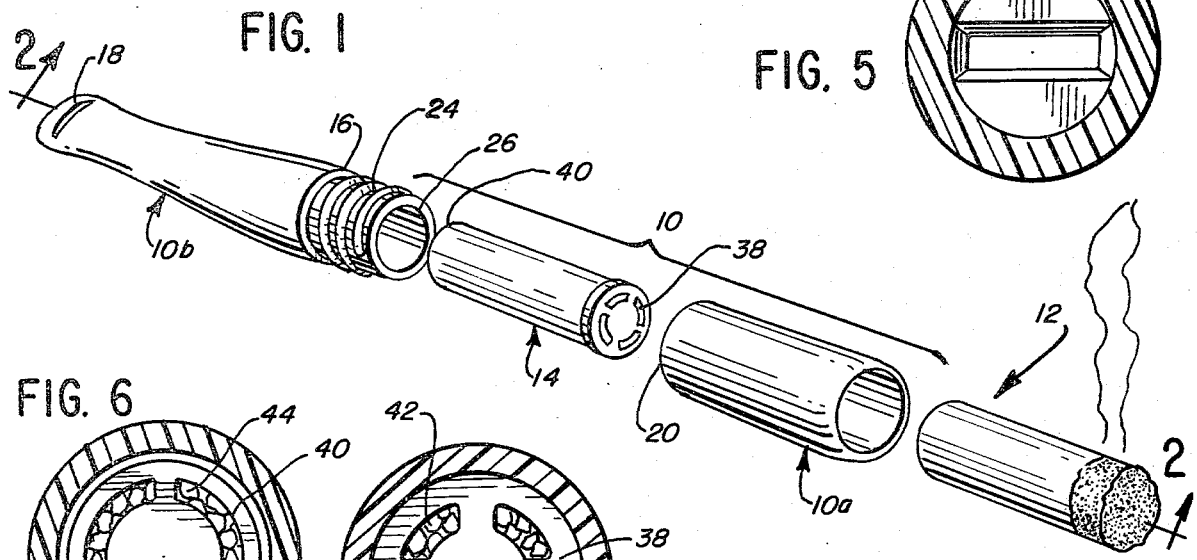
FIG. 1
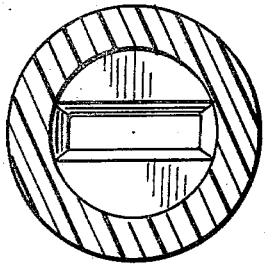
FIG. 5
FIG. 6
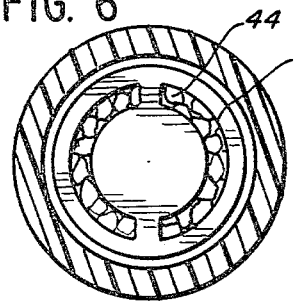
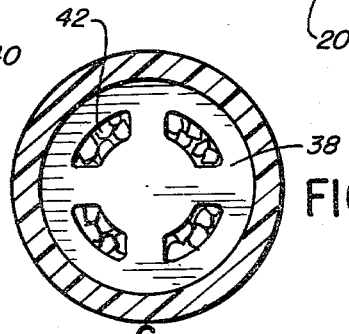
FIG. 7
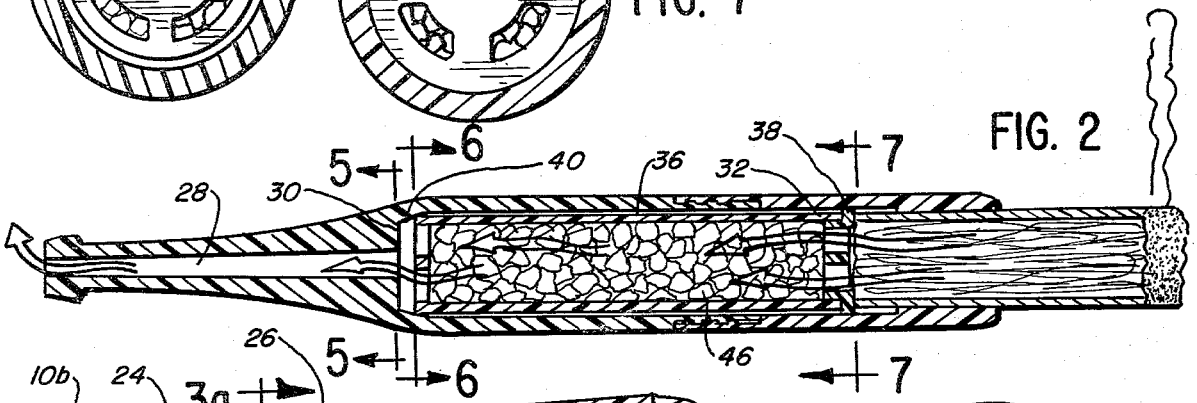
FIG. 2
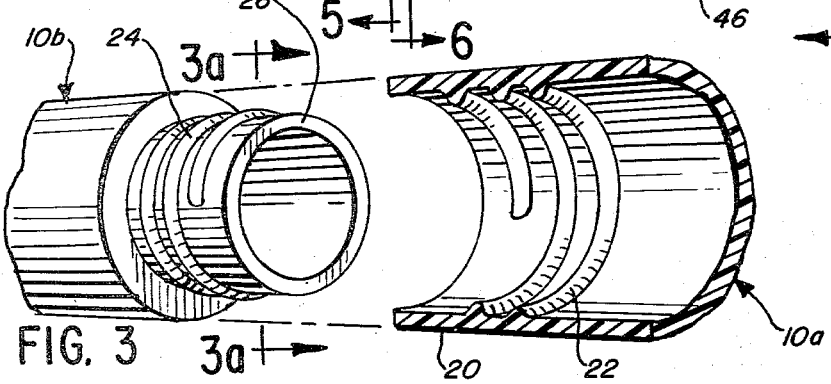
FIG. 3
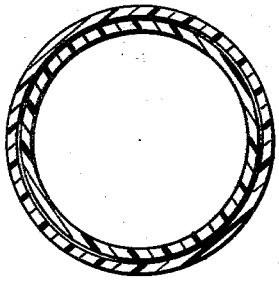
FIG. 3a
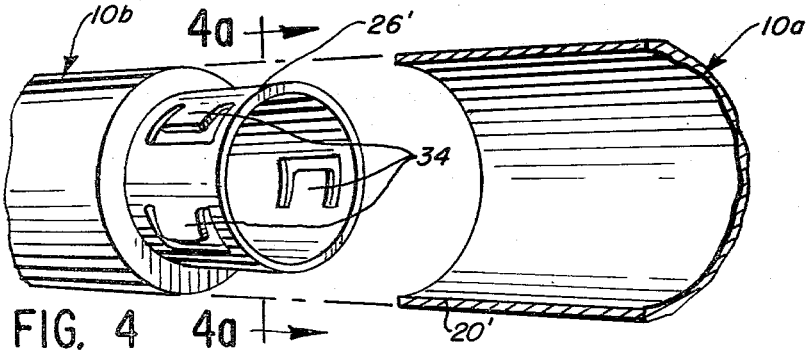
FIG. 4
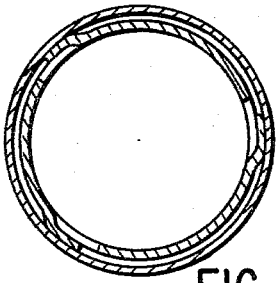
FIG. 4a

MENTHOL FILTER FOR CIGARETTES

FIELD OF THE INVENTION

This invention relates generally to apparatus for filtering smoke from tobacco products, and more particularly, to a menthol, smoke-filtering cartridge adapted for location within a cigarette holder.

BACKGROUND OF THE INVENTION

Since the United States Surgeon General first warned the American public of the deleterious effects of tars and nicotine in tobacco smoke, the cigarette industry has attempted to reduce the harmful effects thereof.

Menthol has long been known to mitigate the toxicity of both tars and nicotine, and is itself non-toxic and beneficial to the mucous membranes of the oral and nasal cavities. In view of these properties, the cigarette industry was quick to add menthol to the cigarette tobacco and consumers were equally quick in their acceptance and purchase of mentholated cigarette. However, it has since been discovered that the menthol, when burned, not only loses its salutory effect, but produces a deadly gas more destructive than the original tars and nicotine.

It is one object of the present invention to provide a menthol cartridge for use with cigarettes, wherein the menthol within the cartridge is not burnt, but is inhaled with the cigarette smoke.

Filtering represents another well recognized method of reducing the tar and nicotine inhaled by the smoker. For the past two decades cigarette companies have incorporated filter tips on their cigarettes to reduce inhalation of harmful fumes. And disposable filter cartridges adapted for location in cigarette holders are commercially available. See Shaw's U.S. Pat. No. 3,048,180 and Gerard et al's U.S. Pat. No. 2,796,869 as state of the art examples of cigarette holders with disposable filters. While these prior filters reduce the quantity of tar and nicotine entering the lungs, they do not chemically react with the fumes to reduce the deleterious effects thereof.

It is another object of the present invention to provide a disposable cartridge for a cigarette holder, the cartridge being filled with menthol crystals for reacting with burning tobacco fumes so as to mitigate the toxicity of tar and nicotine inhaled by the cigarette smoker.

Further objects and advantages of this invention will become apparent as the following description proceeds and the features of novelty which characterize this invention will be pointed out with particularity in the claims annexed to and forming part of the specification.

SUMMARY OF THE INVENTION

An elongated cigarette holder includes a central cavity, one end of which is generally circularly-shaped for receiving therein a cigarette or similar tobacco-filled product, and the opposite end of which is flattened for placement in the mouth of the smoker. Located in the central cavity of the holder is a cylindrical cartridge having vented end walls. The cartridge is filled with menthol crystals and positioned in the holder, such that smoke inhaled from the cigarette passes through the vented end walls, and over and around the menthol crystals prior to inhalation by the smoker. The menthol serves to alleviate the toxic effects of the tars and nicotine and soothe the oral and nasal mucous membranes.

BRIEF DESCRIPTION OF THE DRAWINGS

FIG. 1 is an exploded perspective view of the two-piece cigarette holder, also showing the cigarette and the menthol cartridge of the present invention;

FIG. 2 is a cross-sectional view taken along line 2—2 of FIG. 1 showing the flow of smoke from the cigarette through the cartridge and the holder;

FIG. 3 is an exploded perspective view of a portion of the two-piece cigarette holder with the cigarette holding piece in cross-section to show the interior threading;

FIG. 3*a* is a cross-sectional view taken along line 3*a*—3*a* of FIG. 3 and showing the external threading;

FIG. 4 is an exploded perspective view, with the cigarette holding piece in cross-section, of a portion of the second embodiment of the means of connecting the two-piece cigarette holder;

FIG. 4*a* is a cross-sectional view taken along line 4*a*—4*a* of FIG. 4 and showing outwardly biased locking tabs;

FIG. 5 is a cross-sectional view taken along line 5—5 of FIG. 2 and showing the smoke passage through the flattened holder piece;

FIG. 6 is a cross-sectional view taken along line 6—6 of FIG. 2 showing one vented end of the menthol cartridge; and FIG. 7 is a cross-sectional view taken along line 7—7 of FIG. 2 showing the second vented end of the menthol cartridge.

DESCRIPTION OF THE PREFERRED EMBODIMENT

Referring now to the drawings, a two-piece cigarette holder is shown generally as 10, a cigarette or other smokable tobacco-filled cylinder as 12, and the menthol cartridge as 14.

The preferred embodiment of the cigarette holder 10 is depicted in FIGS. 1—3*a* and comprises a threadably connectable two-piece holder which includes a generally cylindrical cigarette-receiving forward member 10*a* and a rearward member 10*b*. The rearward member 10*b* has one generally circular end 16 and one generally flattened end 18.

The rear end 20 of the cigarette-receiving member 10*a* is internally threaded as at 22 and is adapted to mate with the external threads 24 formed on a reduced diameter extension 26 of the circular end 16 of the flattened member 10*b*. As best seen in FIG. 2, the hollow interior of flattened member 10*b* is suddenly reduced to a narrow smoke flow channel 28. The shoulder 30 formed at the reduced channel 28 defines a stop for the one end of the menthol cartridge 14. The hollow interior of the cigarette-receiving member 10*a* includes an annular flange 32 which serves as a stop for the second end of the menthol cartridge 14.

A second form of the cigarette holder 10 is illustrated in FIGS. 4–4*a*. In this embodiment, the reduced diameter extension 26' of the flattened member 10*b* includes three radially outward biased tabs 34 and the cigarette-receiving member 10*a* has a relatively smooth interior surface at its rearward end 20'.

Provided between the shoulder 30 and the flange 32, when either the first or the second embodiments are interconnected to form an integral unit, is a hollow chamber 36 in which the menthol cartridge 14 is positioned. The distance between the shoulder 30 and the flange 32 is substantially equal to the length of the cartridge 14 so as to prevent the cartridge 14 from moving axially.

The menthol cartridge 14 is a generally cylindrical body having a forward end wall 38 and a rearward end wall 40. The forward end wall 38 is vented as at 42 in FIG. 7 and the rearward end wall 40 is vented as at 44 in FIG. 6. The cartridge is filled with menthol crystals 46. A full description of the chemical configuration and composition of menthol ($C_{10}H_{20}O$) can be found in United States Pat. No. 2,760,993. It should be sufficient to note that menthol is obtained from mint oils, or it is prepared synthetically by the hydrogenation of thymol.

OPERATION

The menthol cartridge 14 is placed within the interior cavity 36 of the flattened member **10*b* of the cigarette holder 10, such that its end wall 40 rests against the shoulder 30 of member 10*b*. The cigarette-receiving member 10*a* of the cigarette holder 10 is either screwed, as in the FIG. 1 embodiment, or friction fit, as in the FIG. 4 embodiment, onto the flattened member 10*b*. With the members 10*a* and 10*b* connected, the other end 38 of the cartridge 14 abuts the flange 32 of member 10*a*** so as to prevent axial cartridge movement.

A cigarette, or other smokable, tobacco-filled cylinder, may be inserted into the tip of the cigarette-receiving member **10*a*. When the cigarette is lit and inhaled, the smoke is drawn through the vents 42 in the forward end wall 42 of the cartridge 14, over and around the menthol crystals 46, through the vents 44 in the rear end wall 40 of the cartridge 14, and along the smoke channel 28 formed in the flattened member 10*b*. By passing the smoke over the menthol crystals 46**, the toxicity of the tars and nicotine is reduced and the beneficial effects of the menthol are felt by oral and nasal cavity membranes.

While particular embodiments of the invention have been shown and described, it will be obvious to those skilled in the art that various changes and modifications may be made therein without departing from the spirit and scope of the invention and, therefore, it is the purpose of the appended claims to cover all such changes and modifications which fall within the spirit and scope of the invention.

What is claimed and desired to be secured by Letters Patent of the United States is:

I claim:

1. An elongated cigarette holder which includes a two-piece cigarette holder having a forward cigarette-receiving member and a rearward mouthpiece member, said members constructed to form a central cavity bounded by the opposed members, said cavity adapted to receive an elongated cylindrical filter cartridge; the improvement comprising, in combination:

said cylindrical filter cartridge having two end walls, each of said end walls having peripheral edge portions, the forward end wall being positioned adjacent said cigarette-receiving member and the rearward end wall positioned adjacent said mouthpiece member, each of said end walls having a plurality of arcuate vents, said rearward end wall having two arcuately shaped vents and said forward end wall having four arcuately shaped vents, the shaped vents in said rearward end wall providing greater flow-through capacity than the vent means in said forward end wall, and said cartridge being filled with menthol crystals;

said cigarette-receiving member constructed to sealingly engage the peripheral edge portion of the forward end wall of said cartridge, and said mouthpiece member adapted to sealingly engage said peripheral edge portion of the rearward end wall of said cartridge;

said central cavity being substantially cylindrically shaped, said mouthpiece member including a tapered wall adapted for engaging the peripheral edge portion of said rearward end wall of said cartridge;

said forward end wall of said cartridge including flange means adapted to engage the inside wall of said central cavity as formed by said cigarette-receiving member so that substantially all of the fumes drawn from a cigarette in said receiving member to said mouthpiece pass through said cartridge and contact the menthol crystals therein; and one of the mouthpiece member and the cigarette-receiving member having a reduced diameter extension which includes a plurality of outward biased tabs, the other of the mouthpiece member and the cigarette-receiving member having an end which includes a relatively smooth interior surface, whereby the mouthpiece member and the cigarette-receiving member are secured together by friction fit of the plurality of tabs against the smooth surface.

* * * * *